United States Patent [19]

Lessin

[11] 4,050,440

[45] Sept. 27, 1977

[54] COMBINATION FIREPLACE/FURNACE

[76] Inventor: Charles L. Lessin, Rte. 1, Cohasset, Minn. 55721

[21] Appl. No.: 727,438

[22] Filed: Sept. 28, 1976

[51] Int. Cl.[2] ..... F24B 1/18

[52] U.S. Cl. ..... 126/120; 237/51

[58] Field of Search ..... 126/120, 121, 122, 125, 126/58, 60, 61, 62, 63, 65, 66, 67, 99 R; 237/51

[56] References Cited

U.S. PATENT DOCUMENTS

| | | | |
|---|---|---|---|
| 1,490,135 | 4/1924 | Skinner | 126/67 |
| 2,019,604 | 11/1935 | Grieve | 126/67 |

*Primary Examiner*—Ronald C. Capossela

*Attorney, Agent, or Firm*—Norman P. Friederichs; Cecil C. Schmidt

[57] ABSTRACT

A combination fireplace/furnace is provided wherein the fire located within the furnace may be viewed as in a fireplace exteriorly of the furnace. The combination fireplace/furnace includes a woodburning furnace having a firebox defining a fire chamber wherein wood may be burned. An opening in the firebox surrounded by a tunnel member extending generally horizontally outwardly from the firebox permits viewing through the tunnel member of a fire burning within the fire chamber. Means are provided to close the tunnel member when viewing of the fire within the fire chamber is not desired. Transparent closure means are also provided to permit viewing through the tunnel while closing off the fire chamber from the viewing area.

29 Claims, 2 Drawing Figures

COMBINATION FIREPLACE/FURNACE

BACKGROUND OF THE INVENTION

1. Field of the Invention

The present invention relates to the field of woodburning furnaces for heating buildings and the like. More specifically, the present invention relates to combination fireplace/furnaces in which wood may be burned to provide a heating system for a building and in which the fire burning within the furnace may be viewed as in a fireplace.

2. Description of the Prior Art

It has, of course, been long known to heat buildings such as houses and the like with the heat produced by burning wood. The earliest of such heating systems typically utilized a fireplace which simply radiated the heat outwardly from the fire produced by the burning wood. The deficiencies of such heating systems are also well known. While a fire burning within a fireplace may be aesthetically pleasing, much of the heat produced by a fireplace is wasted through the flue or chimmney. Heating systems utilizing a fireplace have also encountered difficulties in evenly distributing the heat produced by the fire within the fireplace throughout the room or building which is to be heated. The area nearest the fireplace receives the greatest, perhaps excessive, heat while areas located farther from the fireplace receive less, perhaps insufficient, heat.

Other, more modern, methods of heating a building and the like have been developed which do not contain the deficiencies found in heating systems utilizing fireplaces. One of such more modern heating systems, generally referred to as the forced air system, utilizes the circulation of air heated within a furnace. Forced air heating systems have been developed which utilize oil, gas, or other petroleum fuels as an energy source to heat the air to be circulated. Forced air systems have been developed which utilize wood alone as a fuel and others have been developed which utilize a combination of wood and oil as fuels. Depending upon their sophistication, such systems may or may not be thermostatically controlled.

Forced air systems generally utilize the heat produced by the burning of the fuel (such as wood, oil or a combination of the two) to heat air which is passed through a heat exchanger located within the furnace. The air which is thus heated is circulated to the areas which are to be heated. The advantages to such systems, of course, are that the heated air may be more evenly distributed, resulting in a more even distribution of heat from the system, and the use of automatic, thermostatic controls permits regulation of the heat produced by the burning of the fuel, thus controlling the amount of heat which will be distributed by the air circulation.

While the more modern forced air systems have solved many of the heating problems associated with the use of heating systems utilizing fireplaces, the forced air systems lack much of the visual and aesthetic appeal of fireplaces. The furnaces of the forced air systems typically do not permit viewing of the fire produced by the burning of the fuel within the furnace.

The present invention solves problems associated with these prior art systems. The present invention exhibits the advantages of both the fireplace heating systems and the forced air heating systems without sacrificing the advantages of the other.

SUMMARY OF THE INVENTION

The present invention combines the desirable aspects of both fireplace heating systems and forced air heating systems. The combination fireplace/furnace of the present invention possesses the thermal efficiency of the forced air systems without sacrificing the visual and aesthetic advantages found in the fireplace heating systems.

The combination fireplace/furnace of the present invention includes a woodburning furnace having a firebox which defines a fire chamber in which wood may be burned. The firebox has an opening which is surrounded by means defining a tunnel communicating with the fire chamber through the opening. The tunnel has an open end spaced from the firebox to permit viewing of a fire contained within the fire chamber.

In one embodiment, the combination fireplace/furnace also includes transparent closure means located at the end of the tunnel opposite of the firebox so as to close off air circulation through the tunnel while still permitting viewing of a fire burning within the fire chamber through the transparent closure means and the tunnel. The transparent closure means may take the form of swinging glass doors hingedly attached across the open end of the tunnel.

Movable partition means for closing off the tunnel may also be provided when viewing of a fire burning within the fire chamber is not desired. The partition means may include a movable door positionable within the tunnel to close off communication between the fire chamber and the open end of the tunnel.

In one embodiment, it is preferred that the combination fireplace/furnace be adapted to be positionable adjacent a wall in such a manner that the hole within the firebox be located adjacent the wall. It is contemplated that the means defining the hollow tunnel be extendable through the wall to position the open end of the tunnel on the opposite side of the wall from the firebox, so that the fire within the fire chamber may be viewed through the tunnel from the opposite side of the wall. This enables the combination fireplace/furnace to be positioned adjacent one side of a wall and to have the appearance of a fireplace when viewed from a room located on the opposite side of that wall.

DETAILED DESCRIPTION OF THE DRAWING

Figure 2:
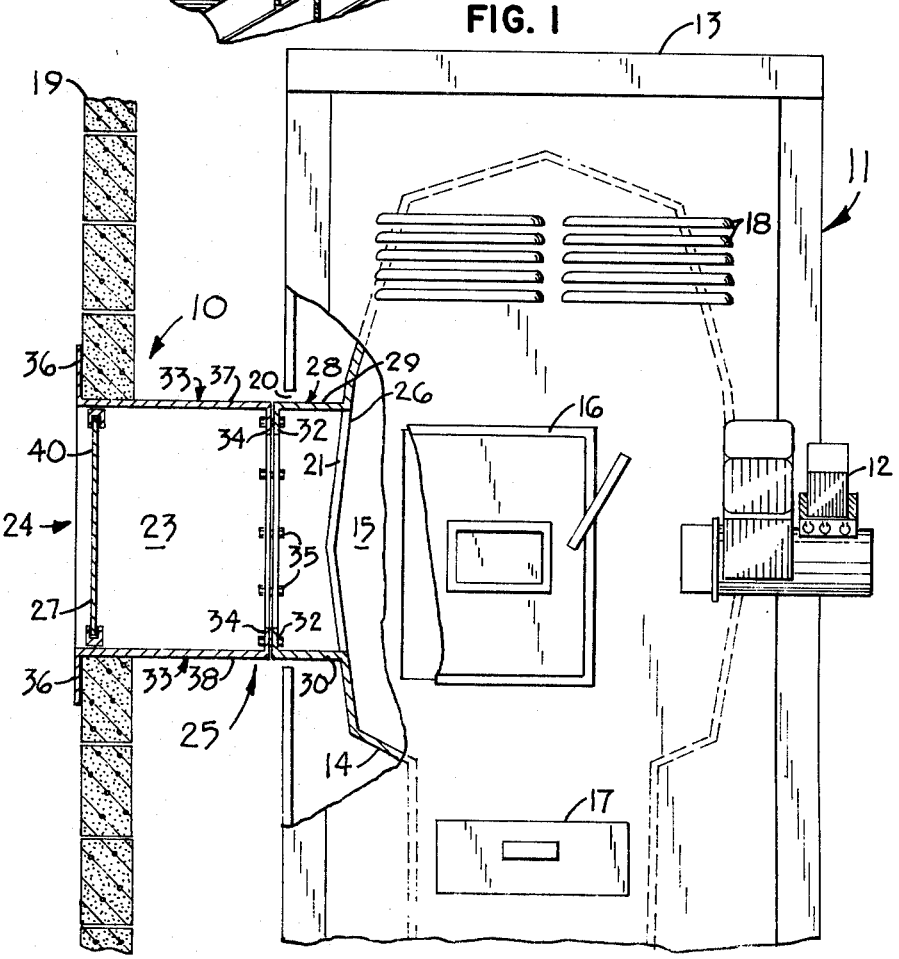
FIG. 2 is a view in side elevation of the combination fireplace/furnace shown in FIG. 1 with portions thereof shown in section and/or broken away.

Referring to the drawing, wherein like numerals represent like elements throughout the several views, there is provided a combination fireplace/furnace generally designated at 10. The fireplace/furnace 10 includes a woodburning furnace generally designated at 11. It is preferred that the woodburning furnace 11 be such as has been well known in the field of forced air heating systems. Since such woodburning furnaces 11 are well known, their make-up and operation will not be described in detail here. It will be appreciated, however, that such woodburning furnaces 11 utilize heat produced by the burning of wood within the furnace 11 to heat air passed through a heat exchanger (not shown) located within the furnace, which air is thereupon circulated to the area to be heated. Such woodburning furnaces 11 may include thermostatic controls 12 to regulate the amount of heat generated by the burning of the wood in the furnace 11. In the case of a strictly woodburning furnace 11, the thermostatic controls 12 regulate the draft of air intake into the burning area to thereby control the intensity of the burning of the wood. While the furnace 11 will be referred to only as "woodburning", it will be understood that the furnace 11 may also utilize a petroleum fuel (such as oil or natural gas) in conjunction with wood. In such instances, the thermostatic controls 12 may be adapted to both control the draft of air to the wood fire to increase or decrease the intensity of the fire (and thus the heat produced) and to ignite the petroleum fuel within the furnace 11 to compensate for a deficiency of heat being produced by the wood fire The furnace 11 includes a generally rectangular, metallic enclosure or housing 13 which surrounds a firebox 14 defining a fire chamber 15 therein. The wood burned within the furnace 11 is burned in the fire chamber 15 upon a grate (not shown) as is well known. The grate may include andirons to give the appearance of a fireplace when viewed exteriorly of the furnace 11. In the case of furnaces 11 which utilize a combination of wood and petroleum fuel as a heat source, the petroleum fuel is also burned within fire chamber 15. The housing 13 and the firebox 14 include a wood supply door 16, shown in FIG. 2, through which wood may be supplied to a fire burning within the fire chamber 15. An ash removal opening 17 is also provided, as also seen in FIG. 2, through which ashes may be removed after the wood has been burned. The housing 13 includes air vents 18 to insure a supply of air for a fire burning within the firebox 14. It is also contemplated that the furnace 11 include a flue (not shown) to exhaust gaseous products produced by a fire burning in the fire chamber 15, as is well known.

It is preferred that the furnace 11 be adapted to be positionable adjacent a wall 19 as shown in the drawings. It will be understood, however, that the wall forms no part of the present invention and is not required for operation of the present invention.

The housing 13 and the firebox 14 have aligned openings 20 and 21, respectively, located adjacent one another. The openings 20 and 21 of the housing 13 and the firebox 14, respectively, are adapted to be positioned adjacent the wall 19. It is preferred that the openings 20 and 21 be generally rectangular in shape.

Means for defining a tunnel 23 are attached to the firebox 14 so as to surround the opening 21 therein and extend generally horizontally outwardly from the firebox 14. The tunnel 23 has an open end 24 spaced from the firebox 14 for permitting viewing of the fire chamber through the tunnel 23. In this manner it will be seen that when a wood fire is burning within the fire chamber 15, it may be observed through the open end 24 of the tunnel 23 much in the manner of a fireplace.

It is preferred that the means for defining the tunnel 23 comprise a hollow box-like tunnel member 25 attached at its first end 26 to the firebox 14 and having its opposite second end 27 extending through a hole in the wall 19 adjacent which the furnace 11 is positioned. The tunnel member 25 includes a duct-like mounting bracket 28 attached at one end to the firebox 14 to surround the opening 21 therein and having its second, other end extending horizontally through the opening 20 in the housing 13. The mounting bracket 28 has a top wall 29, a bottom wall 30 and side walls 31 so as to form a tunnel portion therethrough having a generally rectangular cross section. The second end of the mounting bracket 28 has an inwardly projecting flange 32. The tunnel member 25 also includes a viewing tunnel extension member 33 having an inwardly projecting flange 34 located at its first end which is attached to the flange 32 of the mounting bracket 28 by bolts 35 or other appropriate means. The viewing tunnel extension member 33 extends from its connection to the mounting bracket 28 in a horizontally outward manner through the opening in the wall 19 to a second end having an outwardly projecting flange 36 positioned on the opposite side of the wall 19 from the firebox 14. The viewing tunnel extension member 33 also includes a top wall 37, a bottom wall 38 and side walls 39 so as to define a tunnel portion having a generally rectangular cross section. The rectangular tunnel portions thus defined by the mounting bracket 28 and the viewing tunnel extension member 33 combine to form the tunnel 23 through which a fire burning within the fire chamber 15 may be viewed.

Figure 1:
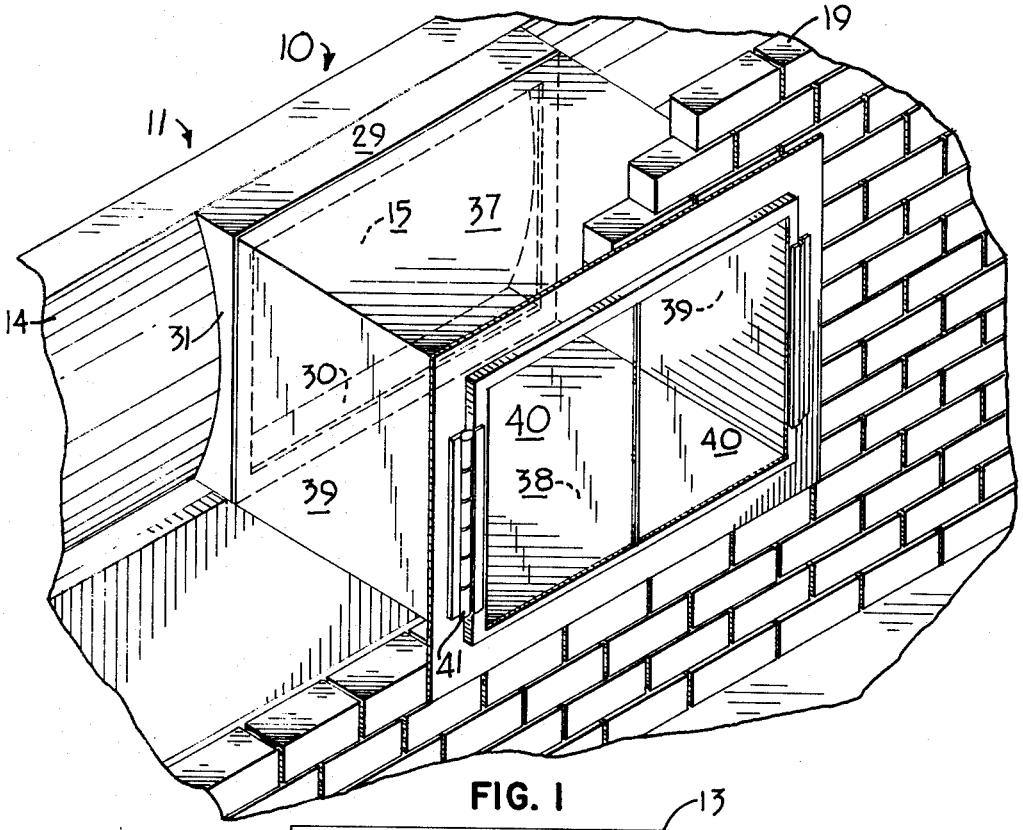
FIG. 1 is a view in perspective of a combination fireplace/furnace according to the present invention positioned adjacent a wall, with portions thereof broken away and the housing omitted.

In those instances wherein the woodburning furnace 11 utilizes a thermostatically controlled draft, transparent closure means may be provided to prevent the unwanted flow of additional air through the open end 24 of the tunnel 23 to the fire chamber 15. It is preferred that these means include glass doors 40 located at the second end 27 of the tunnel member 25. The glass doors 40 are hingedly attached to the outwardly extending flange 36 by hinges 41, as shown in FIG. 1, so as to swing outwardly from the tunnel 23. When closed, the glass doors 41 permit viewing of a fire burning within the fire chamber 15 through the tunnel 23 while closing off additional air flow through the tunnel 23 to the fire chamber 15. The glass doors 40 also prevent soot, ashes, and other by-products of the fire burning within the fire chamber 15 from leaving the combination fireplace/furnace 10 through the tunnel 23 and entering into a room positioned on the opposite side of the wall 19 from the furnace 11. The present invention will thus operate more cleanly than a conventional fireplace. The glass doors 40 may also be opened in order to provide access to the fire chamber 15 for the addition of wood through the tunnel 23 to a fire burning within the fire chamber 15. The necessity for adding wood through the wood supply door 16 is thus eliminated. Wood may be added to a fire from the room located on the opposite side of the wall 19 from the furnace 11.

While two glass doors 40 hinged at their sides have been disclosed, it will be understood that an equivalent arrangement such as a single glass door hinged at its side or at the top so as to close the open end 24 of the tunnel 23 may work equally well within the scope and intent of the present invention.

Movable partition means are provided within the tunnel member 25 for closing communication between the fire chamber 15 and the second end 27 of the tunnel member 25 when viewing is not desired. The movable partition means include a door 42 operable within the tunnel member 25 between a first position wherein the tunnel 23 is closed and a second position wherein the tunnel 23 is opened. Latch means are provided to maintain the door 42 in the second opened position when viewing of a fire within the fire chamber 15 is desired. In this manner, heat loss by radiation or other means through the tunnel 23 may be minimized by placing the door 42 in its first, closed position so as to reflect heat back into the fire chamber 15.

Figure 3:
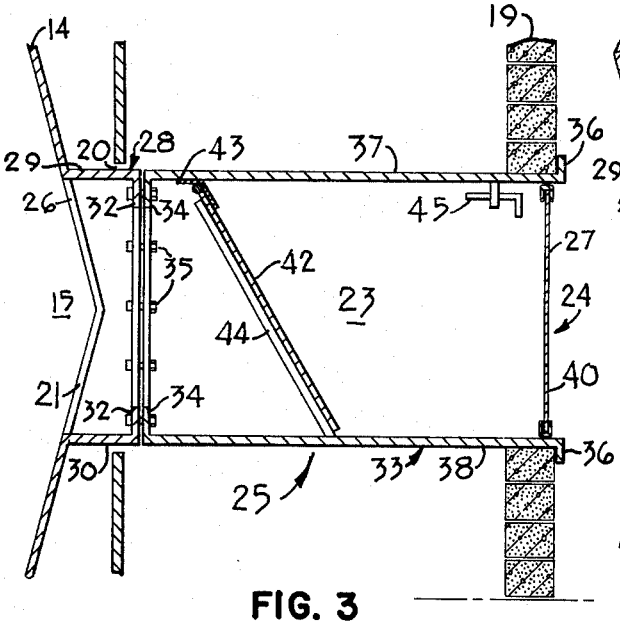
FIG. 3 is a sectional view in side elevation of a portion of one embodiment of the combination fireplace/-furnace shown in FIG. 2.

In one embodiment, the door 42 is hingedly connected to the top wall 37 of the viewing tunnel extension member 33 by a continuous hing 43, as seen in FIG. 3. The door 42 is positionable by gravity in its first, closed position. Door stops 44 attached to the side walls 39 of the viewing tunnel extension member 33 and extending in a direction from the top wall 37 to the bottom wall 38 at an angle inclined from the vertical are provided to prevent the door 42 from wedging closed within the viewing tunnel extension member 33 or from hanging vertically downwardly. In this manner the door 42 may be easily grasped when in its first, closed position and raised to its second, opened position. A spring-loaded latch 45 is utilized to engage the door 42 and to maintain the door 42 in its second, opened position adjacent the top wall 37 of the viewing tunnel extension member 33.

Figure 5:
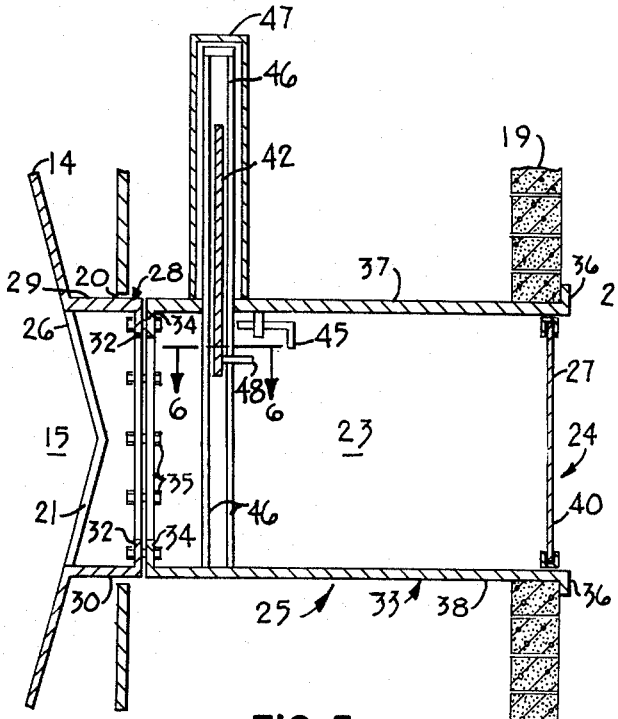
FIG. 5 is a sectional view in side elevation of a portion of still another embodiment of the combination fireplace/furnace shown in FIG. 2.
Figure 7:
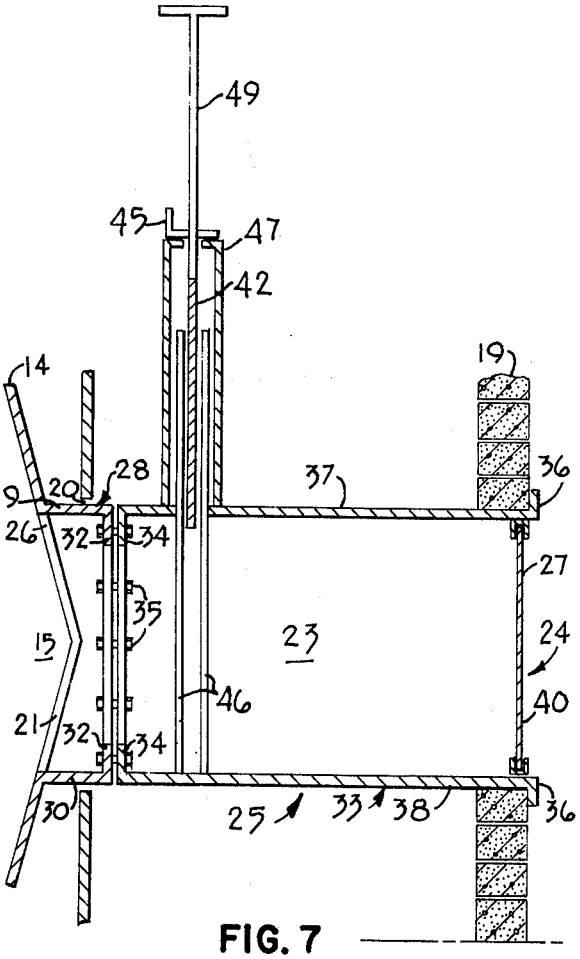
FIG. 7 is a sectional view in side elevation of a portion of yet another embodiment of the combination fireplace/furnace shown in FIG. 2.

In another embodiment, the door 42 is slideably operable within the tunnel 23 between its first, or lowered, closed position and its second, or raised, opened position as shown in FIGS. 5 and 7. The door 42 is positionable by gravity in its first, closed position and maintained by a spring-loaded latch 45 in its second, opened position. In this embodiment, a slot is provided within the top wall 37 of the viewing tunnel member 33 and channel members 46 are attached to the side walls 39 of the viewing tunnel extension member 33 and extend upwardly through the slot. An auxiliary door housing 47 is positioned above the slot in the top wall 37 to receive the door 42 when in its second, opened position. One method of raising the door 42 from its first, closed position to its second, opened position is illustrated in FIG. 5: a handle 48 is located at the bottom of the door 42 and may be utilized to raise the door. When in its second, opened position, the spring-loaded latch 45 is utilized to engage the handle 48 and maintain the door 42 in the second, opened position. Another method is illustrated in FIG. 7: a T-shaped lifting rod 49 is attached to the top of the door 42 and extends through the top of the auxiliary door housing 47. The T-shaped lifting rod 49 is utilized to raise the door 42 to its second, opened position. When the door 42 is in its second, opened position the spring-loaded latch 45 engages the lifting rod 49 in any well known manner to maintain the door 42 in the second, opened position.

Figure 4:
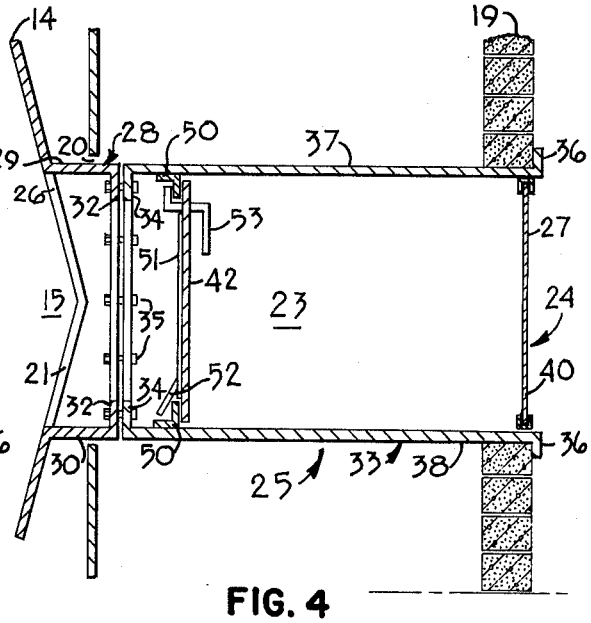
FIG. 4 is a sectional view in side elevation of a portion of another embodiment of the combination fireplace/furnace shown in FIG. 2.
Figure 6:
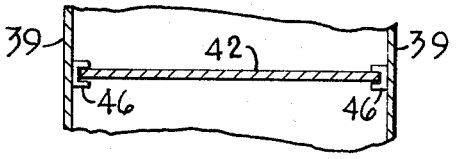
FIG. 6 is a sectional view in top plan taken generally along the line 6—6 in FIG. 5.

In yet another embodiment, illustrated in FIG. 4, the door 42 is completely removable from the tunnel 23. Angular door stops 50 are attached to the top wall 37 and the bottom wall 38 of the viewing tunnel extension member 33. Vertical door stops 51 are also provided along the side walls 39 of the viewing tunnel extension member 33 extending generally from the top wall 37 to the bottom wall 38. The door 42 is positioned within the tunnel 23 in abutting contact with each of the door stops 50 and 51 in order to close off the tunnel 23. To position the door 42 in this manner, a plurality of hook members 52 located at the bottom portion of the door 42 are provided to engage the angular door stop 50 attached to bottom wall 38 of the viewing tunnel member 33 so as to hold the bottom of door 42 in abutting engagement with the angular door stop 50 and the door 42 is rotated upwardly until the top of the door 42 abuts the angular door stop 50 attached to the top wall 37. A latch 53 extending through the door 42 at its top portion is thereupon turned to engage the door stop 50 at the top portion of the door 42 to thus maintain the door 42 in abutting contact with the door stops 50 and 51. To remove the door 42, the latch 53 is simply turned to release engagement with the angular door stop 50 located at the top wall 37 and the door 42 is pivoted downwardly and lifted out of the tunnel 23.

In order that the door 42 prevent heat loss through the tunnel 23 when the door 42 is in its first, closed position, it is preferred that the door 42 comprise a non-flammable material in which that surface of the door 42 which faces the fire chamber 23 comprises asbestos. In this manner, heat loss through door 42 by convection and/or radiation is minimized due to the well known insulating properties of asbestos.

In operation, the combination fireplace/furnace operates with the thermal efficiency of a forced air furnace and contains the visual and aesthetic advantages of a fireplace. Since the fire is contained within the fire chamber 15, the combination fireplace/furnace operates exactly in the same manner as a normal forced air, woodburning furnace. When viewed from the opposite side of the wall 19, however, the fire within the fire chamber 15 in the furnace 11 appears as a fire in a fireplace when the door 42 is in its second, opened position. While the tunnel member 25 has been described as extending through the wall 19, this is not an essential feature of the present invention, but rather a refinement contained in the preferred embodiment. The present invention will work equally as well when the tunnel member 25 does not extend through a wall but where the fire is simply viewed from adjacent the furnace 11.

While the preferred embodiment of the present invention has been described, it will be understood that the present invention is limited in scope only by the appended claims.

What is claimed is:

1. A combination fireplace/furnace comprising:

a. a woodburning furnace having a firebox defining a fire chamber, said firebox having an opening therein;

b. means attached to said firebox and extending generally horizontally outwardly therefrom for defining a hollow tunnel surrounding the opening therein, said means being adapted for extension through a partition wall;

c. said tunnel having an open end spaced from said furnace for permitting viewing of said fire chamber through said tunnel whereby said firebox may be disposed on one side of a partition wall and said open end may be disposed on the opposite side of said partition wall.

2. The combination of claim 1, wherein said means for defining a hollow tunnel comprises a box-like tunnel member having a first end attached to said firebox, and an opposite second end spaced therefrom.

3. The combination of claim 2 further comprising movable partition means for closing communication between said fire chamber and said open end of said tunnel.

4. The combination of claim 3, wherein said partition means comprises a hinged door pivotally movable between a first position closing said tunnel, and a second position opening said tunnel.

5. The combination of claim 3, wherein said partition means comprises a sliding door slideably operable between a first position closing said tunnel, and a second position opening said tunnel.

6. The combination of claim 3, wherein said partition means comprises a removable door positionable within said tunnel to close off communication between said fire chamber and said open end of said tunnel.

7. A combination fireplace/furnace comprising:

a. a woodburning furnace having a firebox defining a fire chamber, said firebox having an opening therein;

b. means attached to said firebox and extending generally horizontally outwardly therefrom for defining a hollow tunnel surrounding the opening therein said means extending through a wall; and c. transparent closure means located opposite said firebox for permitting viewing of said fire chamber through said tunnel, whereby said firebox may be positioned adjacent one side of a wall and said tunnel has the appearance of a fireplace when viewed from a room located on the opposite side of the wall.

8. The combination of claim 7, wherein said means for defining a hollow tunnel comprises a box-like tunnel member having a first end attached to said firebox, and an opposite second end spaced therefrom.

9. The combination of claim 8, wherein transparent closure means comprising glass doors are attached to said second end of said tunnel member.

10. The combination of claim 8 further comprising movable partition means within said tunnel member for closing communication between said fire chamber and said second end of said tunnel member.

11. The combination of claim 10, wherein said partition means comprises a hinged door pivotally movable between a first position closing said tunnel, and a second position opening said tunnel.

12. The combination of claim 10, wherein said partition means comprises a sliding door slideably operable between a first position closing said tunnel, and a second position opening said tunnel.

13. The combination of claim 10, wherein said partition means comprises a removable door positionable within said tunnel to close off communication between said fire chamber and said second end of said tunnel member.

14. A combination fireplace/furnace comprising:

a. a woodburning furnace having a firebox defining a fire chamber, said firebox having an opening therein;

b. a hollow tunnel member attached at one end to said firebox so as to surround the opening therein, said tunnel member extending horizontally outwardly of said furnace and being in communication at one end with said fire chamber through the opening in said firebox;

c. transparent closure means located at an opposite end of said tunnel member for permitting viewing of said fire chamber through said tunnel member; and d. means for closing said tunnel between said fire chamber and said closure means when viewing is not desired.

15. The combination of claim 14, wherein said transparent closure means comprises glass doors attached to said opposite end of said tunnel member.

16. In combination with a woodburning furnace adapted to be positioned adjacent a wall and having a firebox defining a fire chamber, the firebox also defining an opening therein adjacent the wall, fireplace apparatus comprising:

a. a hollow tunnel member attached at one end to the firebox so as to surround the opening therein, said tunnel member extending horizontally outwardly from said surface such that an opposite end of said tunnel extends through the wall; and b. transparent closure means located at said opposite end of said tunnel member for permitting viewing of the fire chamber through said tunnel member, whereby said firebox is located on one side of said wall and said transparent closure member is located on the opposite side of said wall.

17. The combination of claim 16, wherein said transparent closure means comprises glass doors attached to said opposite end of said tunnel member.

18. The combination of claim 17 further comprising partition means for closing communication between the fire chamber and said opposite end of said tunnel member.

19. The combination of claim 18, wherein said partition means comprises a hinged door pivotally operable between a first closed position and a second opened position.

20. The combination of claim 18, wherein said partition means comprises a sliding door slideably operable between a first closed position and a second opened position.

21. The combination of claim 18, wherein said partition means comprises a removable door positionable within said tunnel member so as to close off communication between said fire chamber and said second end of said tunnel member.

22. In combination with a woodburning furnace adapted to be positioned adjacent a wall, the furnace having a firebox defining a fire chamber and a housing surrounding the firebox, the firebox and housing having aligned openings respectively therein adjacent the wall, fireplace apparatus comprising:

a. a duct-like mounting bracket attached at a first end to the firebox so as to surround the opening therein and having a second end extending horizontally through the opening in the housing;

b. a duct-like viewing tunnel extension member attached at a first end to said second end of said bracket and extending horizontally outwardly therefrom, a second end of said viewing tunnel extension member being adapted to extend through an opening in the wall;

c. glass doors attached to said second end of said viewing tunnel extension member thereby permitting viewing of the interior of the fire chamber; and d. a non-flammable partition positionable in said viewing tunnel extension member to close off communication between the fire chamber and said second end of said viewing tunnel extension member when viewing is not desired.

23. The combination of claim 22, wherein said partition has at least one asbestos surface.

24. The combination of claim 22, wherein said mounting bracket comprises a top wall, a bottom wall, and two side walls, so as to form a tunnel portion having a rectangular cross section.

25. The combination of claim 22, wherein said viewing tunnel extension member comprises a top wall, a bottom wall, and two side walls, so as to form a tunnel portion having a rectangular cross section.

26. The combination of claim 25, wherein said partition comprises a hinged door hingedly attached to said top wall of said viewing tunnel extension member and is positionable by gravity to close off communication between the fire chamber and said second end of said viewing tunnel extension member, the combination further comprising latch means for maintaining said hinged door in the opened position.

27. The combination of claim 25, wherein said partition comprises a removable door positionable within said viewing tunnel extension member, and wherein the combination further comprises stop members located within the viewing tunnel extension member and latch means for maintaining said removable door in abutting contact with said stop members to maintain said door in a closed position.

28. The combination of claim 25 further comprising channel members attached to said side walls of said viewing tunnel extension member and extending in a direction from said top wall to said bottom wall, said top wall of said viewing tunnel extension member defining a slot therein, and wherein said partition comprises a sliding door slideable operable within said channel members between a closed position and an opened position wherein said sliding door extends upwardly through said slot and above said top wall of said viewing tunnel extension member.

29. The combination of claim 28 further comprising an auxiliary door housing positioned above said slot in said top wall to receive said sliding door when said sliding door in said opened position, and latch means for maintaining said sliding door in said opened position.

* * * * *